US006458299B1

(12) United States Patent
Wierer et al.

(10) Patent No.: US 6,458,299 B1
(45) Date of Patent: Oct. 1, 2002

(54) PRODUCTION OF FIBER WEBS BY THE AIRLAID PROCESS

(75) Inventors: Konrad Alfons Wierer; Holger Poths; Richard Goetze, all of Burghausen (DE)

(73) Assignee: Wacker Chemie GmbH, Munich (DE)

( * ) Notice: Subject to any disclaimer, the term of this patent is extended or adjusted under 35 U.S.C. 154(b) by 0 days.

(21) Appl. No.: 09/551,243

(22) Filed: Apr. 17, 2000

(30) Foreign Application Priority Data

Apr. 22, 1999 (DE) ..... 199 18 343

(51) Int. Cl.[7] ..... B27N 3/04; B29C 43/30

(52) U.S. Cl. ..... 264/112; 264/113; 264/121; 264/122

(58) Field of Search ..... 264/518, 112, 264/113, 122, 121, 517

(56) References Cited

U.S. PATENT DOCUMENTS

| | | | | |
|---|---|---|---|---|
| 4,869,950 A | | 9/1989 | Elsen et al. | |
| 4,978,489 A | * | 12/1990 | Radvan et al. | 156/166 |
| 5,128,082 A | * | 7/1992 | Makoui | 264/112 |
| 5,237,945 A | * | 8/1993 | White | 112/420 |
| 5,886,121 A | | 3/1999 | Kinkel et al. | |
| 5,977,244 A | | 11/1999 | Kohlhammer et al. | |

FOREIGN PATENT DOCUMENTS

| | | |
|---|---|---|
| DE | 43 06 808 | 9/1994 |
| EP | 0 301 772 | 2/1989 |
| EP | 0 687 317 | 11/1996 |
| EP | 0 894 888 | 2/1999 |
| WO | 90/11171 | 10/1990 |
| WO | 90/14457 | 11/1990 |
| WO | 96/39553 | 12/1996 |

OTHER PUBLICATIONS

European Search Report.
Derwent Abstract corresponding to EP 0 894 888 (AN 1999–108373).
Fox T.G., Bull. Am. Physics Soc. 1, 3, p. 123 (1956).
Polymer Handbook, 3rd Edition, J. Wiley & Sons, New York (1989), pp III–139 to III–191.
Derwent Abstract corresponding to EP 0 687 317 (AN 1994–280617).

* cited by examiner

*Primary Examiner*—Mary Lynn Theisen
(74) *Attorney, Agent, or Firm*—Brooks & Kushman P.C.

(57) ABSTRACT

Disclosed is a process for producing fiber webs by the airlaid process of laying down the fibers and the pulverulent binder in an air stream, which includes a first step of laying a fiber web or fibers up to a basis weight of 10 to 50 g/m$^2$, a subsequent step of laying down fibers and a thermoplastic polymer powder based on polymers of one or more monomers such as a vinyl ester or a (meth)acrylic ester separately or as a mixture in the air stream in an amount of 10 to 300 g/m$^2$ and, if appropriate, repeating this step until the desired basis weight is obtained, and consolidating the fiber material at temperatures of 80° C. to 260° C. and, if appropriate, at a pressure of up to 100 bar.

12 Claims, 2 Drawing Sheets

PRODUCTION OF FIBER WEBS BY THE AIRLAID PROCESS

Figure 1:
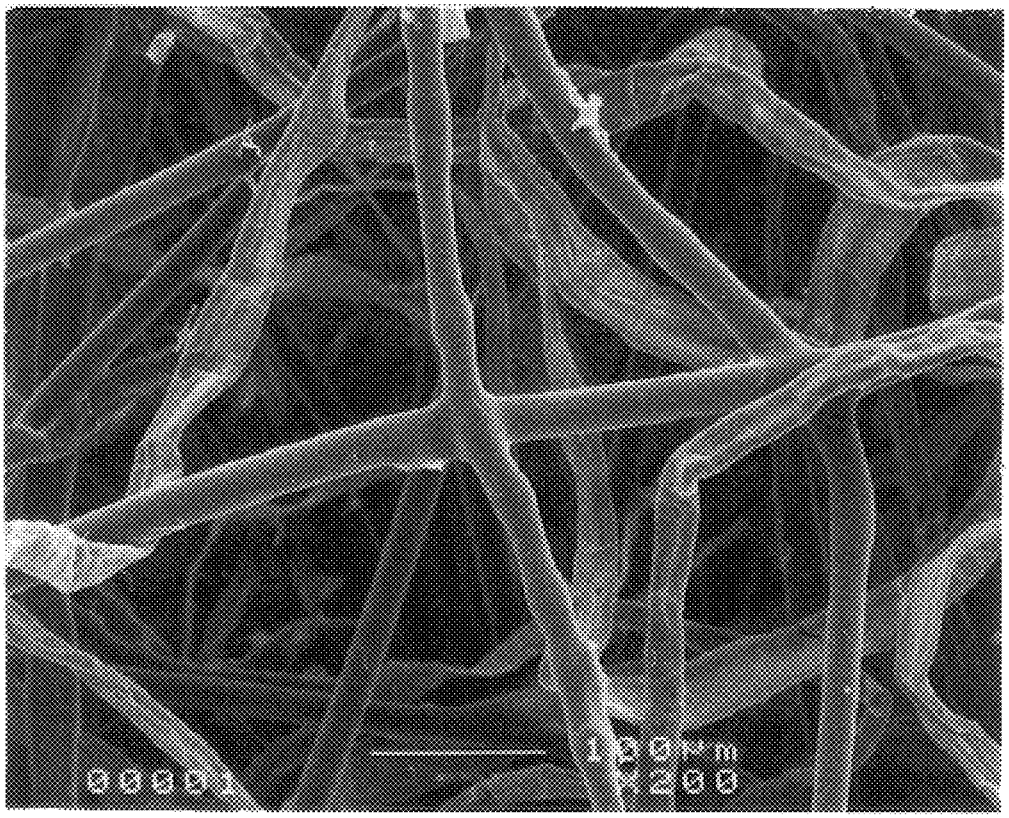

This invention relates to a process for producing fiber webs by the airlaid process of laying down fibers and a pulverulent binder in an air stream, to the webs obtainable thereby and to their use.

WO-A 96/39553 gives an account of the background art of manufacturing airlaid nonwoven materials used, for example, in hygiene products, household articles or filter media. Natural fibers, for example, cellulose fibers (fluff pulp), are blown by air onto a wire, the air is aspirated and the sheetlike fibrous structure thus obtained is consolidated using an aqueous binder or thermoplastic fibers under the influence of heat, pressure and/or water jets. WO-A 96/39553 itself concerns the manufacture of non-wovens by the airlaid process by bonding the fiber using an aqueous polymer dispersion and controlling the degree of penetration of the latex binder into the laid fibrous structure through the spray pressure and/or the vacuum applied.

The disadvantage of airlaids bound using aqueous binders only is the inadequate throughbonding of the web at high basic weights, so that web layers on the inside may delaminate. The reason for this is that, in the case of thick webs, the polymer fraction of the binder dispersion does not fully penetrate and it is just water which gets through to the interior of the fibrous structure. Heavy airlaids having basic weights of>60 g/m$^2$ are accordingly finished using an additional costly production step, for example, lamination with hotmelt adhesives.

The binding of airlaids using thermoplastic binding fibers, predominantly based on a polyolefin, presents difficulties due to dusting or linting in production and finishing since these materials are insufficiently bonded with regard to very short natural fibers. Similarly, the adhesion of these binding fibers to the polar fluff pulp fibers is inadequate because of their apolar character, necessitating increased binder quantities. At the same time, the hydrophobic binding fiber significantly reduces the absorption capacity with regard to aqueous fluids, which conflicts with any use as an absorption medium in hygiene articles, one of the main applications for bulky airlaids.

WO-A 90/11171 describes the production of fibrous structures by an airlaid process in which natural fibers, preferably wood fibers, are sprayed with binder latex and dried, so that they are completely impregnated with a thermoplastic binder layer. The fiber is consolidated in a second step by means of heat and pressure. The disadvantage with complete impregnation is the change in the physical properties of the completely enrobed natural fiber surface. For instance, the fiber's absorption capacity for aqueous fluids may deteriorate as a result, so that such a process is not suitable for producing absorbent airlaids. In addition, this reference advises against processing conditions which will cause the dispersed binder particles to dry, since the view is taken that dry binders have little if any adhesion to the fiber.

The use of pulverulent binders such as a phenolic resin powder or a polypropylene powder is known with regard to the production of card webs (randomizer cards). In WO-A 90/14457, for example, glass fibers are carded into a random web which is besprinkled with powder. The powder-containing web is subsequently folded in such a way that a plurality of layers are in superposition and is consolidated by the action of heat and pressure. The carding of fibers, unlike the airlaid process, is used for producing very thick fibrous structures having a basic weight of 2000 to 4000 g/m$^2$, generally from fibers>20 mm in length. The disadvantage is the complicated laydown technology, which at the low basic weights typical of airlaid products, produces a non-uniform web whose non-uniformities only disappear with increasing basic weight.

The use of crosslinkable polymer powders in processes wherein the powder is sprinkled into previously laid, optionally pre-consolidated, fiber materials is described in EP-B 687317 and EP-A 894888. The disadvantage is that the airlaying of a fiber/powder mixture is associated with considerable powder losses and relatively thick airlaids are not obtainable by simply laying a fiber/powder mixture, but the products obtainable in such a way would have to be expensively laminated.

It is therefore an object of the present invention to provide a process for producing fiber webs by an airlaid process whereby even thick and bulky airlaid webs having a basic weight of>60 g/m$^2$ and optimal throughbonding are obtainable without the need for complicated laminating steps and without restricting the absorbency of the fiber.

This object is achieved by a process for producing fiber webs by the airlaid process of laying down the fibers and the pulverulent binder in an air stream, which comprises a) a first step of laying a fiber web or fibers up to a basic weight of 10 to 50 g/m$^2$, b) a subsequent step of laying down fibers and a thermoplastic polymer powder based on polymers of one or more monomers selected from the group of the vinyl esters and (meth)acrylic esters separately or as a mixture in the air stream in an amount of 10 to 300 g/m$^2$ and, if appropriate, repeating this step until the desired basic weight is obtained, and c) consolidating the fiber material at temperatures of 80° C. to 260° C. and, if appropriate, at a pressure of up to 100 bar.

Useful fiber materials include all natural and synthetic fiber materials. There is no a priori restriction with regard to the choice of fiber materials; all fiber raw materials which are used in the non-wovens industry are contemplated for use, for example polyester, polyamide, polypropylene, polyethylene, glass, ceramic, viscose, carbon, cellulose, cotton, wool and wood fibers. Preference is given to polyester, polyamide, glass, cellulose, cotton, wool and wood fibers. Particular preference is given to natural fibers such as cellulose, cotton, wool and wood fibers, especially cellulose fibers such as pulp fibers.

Suitable thermoplastic polymer powders are polymers of one or more monomers selected from the group of the vinyl esters of branched or unbranched carboxylic acids having 1 to 12 carbon atoms and the esters of acrylic acid and methacrylic acid with branched or unbranched alcohols having 1 to 12 carbon atoms. Preference is given to short-chain vinyl esters having 1 to 4 carbon atoms in the carboxylic acid moiety such as vinyl acetate, vinyl propionate, vinyl butyrate and 1-methylvinyl acetate. Preference is also given to short-chain methacrylic esters or acrylic esters having 1 to 4 carbon atoms in the ester moiety such as methyl acrylate, methyl methacrylate, ethyl acrylate, ethyl methacrylate, propyl acrylate, propyl methacrylate, n-butyl acrylate and n-butyl methacrylate.

If desired, the polymer on which the powder is based is a copolymer which additionally contains units derived from 0.05 to 10.0% by weight, based on the total weight of the monomers, of polar comonomers selected from the group consisting of ethylenically unsaturated mono- and dicarboxylic acids and their amides, such as acrylic acid, methacrylic acid, maleic acid, fumaric acid, itaconic acid, acrylamide, methacrylamide; ethylenically unsaturated sulfonic acids and their salts, preferably vinylsulfonic acid, 2-acrylamidopropanesulfonate and N-vinylpyrrolidone.

Preference is given to hydrophilic polymers whose hydrophilicity is retained by partial hydrolysis of the vinyl ester or methacrylic ester units and, if appropriate, by a polar comonomer fraction in the polymer. Hydrophilic polymers for the purposes of the present invention are therefore polymers which contain not less than 50% by weight of the abovementioned short-chain vinyl ester or (meth)acrylic ester units or at least 5% by weight of the polar comonomers mentioned, each percentage being based on the total weight of the monomers. In the case of core-shell polymers, the weight percentages mentioned apply to the shell polymer.

For applications in the building construction sector in particular, it may be useful, if appropriate, to use hydrophobic copolymers which, as well as the vinyl ester or (meth) acrylate comonomers, contain one or more hydrophobic comonomers selected from the group consisting of long-chain vinyl esters having 5 to 11 carbon atoms in the ester moiety, for example, vinyl 2-ethylhexanoate, vinyl laurate, vinyl pivalate and vinyl esters of alpha-branched monocarboxylic acids having 9 to 11 carbon atoms, for example VeoVa9® or VeoVa10® (tradenames of Shell); aromatic vinyls, for example, styrene, methylstyrene and vinyltoluene; vinyl halides, for example, vinyl chloride; olefins, for example, ethylene and propylene; dienes, for example, 1,3-butadiene and isoprene; and also diesters of dicarboxylic acids such as fumaric acid or maleic acid, for example, dibutyl maleate and diisopropyl fumarate. In general, the fraction of hydrophobic comonomers is not less than 20% by weight, preferably 20 to 70% by weight, based on the total weight of the copolymer.

In a preferred embodiment, the pulverulent binders are heat-curable in that they crosslink at an elevated temperature. It is therefore also possible to use crosslinkable comonomers, preferably in amounts of 0.05 to 10% by weight, based on the total weight of the monomers, such as acrylamidoglycolic acid (AGA), methyl methacrylamidoglycolate (MAGME), N-methylolacrylamide (NMA), N-methylolmethacrylamide (NMMA), N-methylolallyl carbamate, alkyl ethers of N-methylolacrylamide or N-methylolmethacrylamide such as their isobutoxy ethers or n-butoxy ethers. Further examples of crosslinkable comonomers are alkoxysilane-functional monomers such as acryloyloxypropyltri(alkoxy)- and methacryloyloxypropyltri(alkoxy)-silanes, vinyltrialkoxysilanes and vinylmethyldialkoxysilanes, preferably vinyltriethoxysilane and gamma-methacryloyloxypropyltriethoxysilane. Preferred crosslinked comonomers are N-methylolacrylamide (NMA), N-methylolmethacrylamide (NMMA), N-methylolallyl carbamate, alkyl ethers of N-methylolacrylamide or N-methylolmethacrylamide such as their isobutoxy ethers or n-butoxy ethers.

The polymer composition is chosen so that the pulverulent binders are heat-activatable, i.e., soften at elevated temperature. The polymer composition is therefore chosen so as to bring about a glass transition temperature Tg of −40° C. to +150° C., preferably of −20° C. to +50° C. The glass transition temperature Tg of polymers can be determined in a known manner by means of differential scanning calorimetry (DSC). The Tg can also be approximately predicted by means of the Fox equation. According to Fox T. G., Bull. Am. Physics Soc. 1, 3, page 123 (1956): $1/Tg=x_1/Tg_1+x_2/Tg_2+\ldots+x_n/Tg_n$, where $x_n$, is the mass fraction (% by weight/100) of monomer n and $Tg_n$, is the glass transition temperature in degrees Kelvin of the homopolymer of said monomer n. Tg values of homopolymers are recited in Polymer Handbook 3rd Edition, J. Wiley & Sons, New York (1989).

Preferred hydrophilic polymers are those recited hereinbelow, for which the stated weight percentages, including any fraction of polar or crosslinkable comonomers, add up to 100% by weight:

- vinyl acetate polymers, optionally containing 0.05 to 10% by weight of N-methylolacrylamide;
- vinyl acetate-ethylene copolymers having an ethylene content of 1 to 30% by weight, optionally containing 0.05 to 10% by weight of N-methylolacrylamide;
- vinyl acetate-ethylene-vinyl chloride copolymers having ethylene and vinyl chloride contents of together 5 to 30% by weight;
- vinyl acetate-acrylate copolymers containing one or more short-chain acrylic esters selected from the group consisting of methyl acrylate, ethyl acrylate, propyl acrylate and butyl acrylate;
- acrylic ester polymers of one or more short-chain acrylic esters selected from the group consisting of methyl acrylate, ethyl acrylate, propyl acrylate and butyl acrylate, optionally containing 0.05 to 10% by weight of N-methylolacrylamide.

Preferred hydrophobic polymers are recited hereinbelow, for which the stated weight percentages, including any fraction of crosslinkable comonomers, add up to 100% by weight:

- vinyl acetate copolymers with 20 to 50% by weight of diesters of dicarboxylic acids, especially dibutyl maleate and/or diisopropyl fumarate, which optionally contain in addition 1 to 15% by weight of ethylene;
- vinyl acetate copolymers with 20 to 50% by weight of one or more copolymerizable vinyl esters such as vinyl laurate, vinyl pivalate, vinyl 2-ethylhexanoate, vinyl esters of an alpha-branched carboxylic acid, especially vinyl versatate (VeoVa9®, VeoVa10®, VeoVa11®), which optionally contain in addition from 5 to 30% by weight of ethylene;
- styrene-acrylic ester copolymers such as styrene-n-butyl acrylate or styrene-2-ethylhexyl acrylate having a styrene content of 30 to 70% by weight in each case.

The polymers are prepared in a known manner by bulk, solution, suspension or emulsion polymerization and, if appropriate, subsequent drying. Drying can be effected by means of known processes; by suction filtration and drying in the case of suspension polymers; by precipitating the polymers or distilling off the solvent and subsequent drying in the case of solution polymers; by spray drying or by coagulation of the dispersion and subsequent fluidized bed drying of the coagulate in the case of emulsion polymers.

The polymerization is carried out in conventional reactors, including pressure reactors, in a temperature range from 30° C. to 80° C. and initiated in the usual manner by customary, water-soluble or water-insoluble free-radical formers, which are preferably used in amounts of 0.01 to 3.0% by weight based on the total weight of the monomers. Examples of water-insoluble initiators are diacetyl peroxydicarbonate, dicyclohexyl peroxydicarbonate, dibenzoyl peroxide; examples of water-soluble initiators are sodium persulfate, hydrogen peroxide, t-butyl peroxide, t-butyl hydroperoxide; potassium peroxodiphosphate, azobisisobutyronitrile. If appropriate, the free-radical initiators mentioned may also be combined in a known manner with 0.01 to 0.5% by weight, based on the total weight of the monomers, of reducing agents. Useful are, for example, alkali metal formaldehydesulfoxylates and ascorbic acid. A redox initiation is preferably carried by metering one or both redox catalyst components during the polymerization.

A suspension polymerization is carried out in the presence of the customary protective colloids such as polyvinyl alcohol, cellulose derivatives such as hydroxyethylcellulose, polyvinylpyrrolidone; an emulsion polymerization is carried out in the presence of customary emulsifiers, i.e., anionic, cationic and also nonionic emulsifiers. Protective colloids and emulsifiers are normally used in an amount of 0.5 to 6% by weight, based on the total weight of the monomers. The polymerization can be carried out batchwise or continuously, with or without use of seed latices, with initial charging of all or individual ingredients of the reaction mixture or with partial initial charging and subsequent metered addition of the or individual ingredients of the reaction mixture, or without initial charge by the metered addition method. The solids content of the dispersion thus obtainable is 20 to 70%.

The polymer dispersions are preferably dried by spray drying or by coagulation of the dispersion and subsequent fluidized bed drying of the coagulate. The preferred drying method is spray drying in customary spray dryers, and the atomizing may be effected using one-, two- or multi-material nozzles or using a rotating disk. The exit temperature is generally within the range from 55° C. to 100° C., preferably 65° C. to 90° C., depending on the apparatus, the Tg of the resin and the desired degree of drying. For spray drying, the polymer dispersion preferably has a solids content of 20% to 70% and is sprayed, and dried, together with protective colloids as a spraying aid. Useful protective colloids include for example partially hydrolyzed polyvinyl alcohols, polyvinylpyrrolidones, starches, melamineformaldehydesulfonates and naphthaleneformaldehydesulfonates. The amount of protective colloid added in this step is preferably 5 to 20% by weight, based on the polymer.

A particular advantage of the powder prepared by a suspension polymerization and dried by spray drying is that, owing to the protective colloid fraction, water-activatable binding powders are obtained; that is, the melt viscosity of the polymer powders can be reduced by adding water. Non-water-activatable polymer powders are obtained for example by isolating by coagulation and subsequent fluidized bed drying. Water-activatable powders are preferred for fiber binding. Non-water-activatable powders are rather sealable binders and are used when the fiber is subsequently to be bonded to another substrate by heat sealing.

The polymer powders have a melt flow index (MFI) of 2 to 300, preferably 15 to 80, g/10 min at 190° C. and a load weight of 2.16 kg. The MFI value is determined on an MPS-D Gottfert MFI instrument by the DIN 53735 method. The molecular weight is 15,000 to 800,000, preferably 100,000 to 200,000. The molecular weight is reported as a weight average determined by gel permeation chromatography (GPC) versus sodium polystyrenesulfonate standards. The preferred particle size is 50 to 400 $\mu$m, particularly preferably, 100 to 400 $\mu$m.

The process of the invention can be practiced on conventional airlaid ranges incorporating a plurality of successive forming heads for blowing the fiber and/or powder mixture with air. The number of forming heads depends on the desired basic weight for the fiber web and process variants.

In the first step, the fiber material may be laid in the form of the prefabricated fiber web, or airlaying may be used to lay a first fiber layer of loose fibers. If a prefabricated fiber web is laid, the non-woven may be laid in the form of a random web, a non-woven scrim, as a spunbound web or as a polymer-bound web. If loose fibers are used, this and the subsequent steps are preferably performed using short fibers having a fiber length of≦20 mm, preferably 1 to 18 mm, especially 2 to 12 mm. The basic weight of the fiber web or loose fibers laid in the first step is -10 to 50 g/m$^2$.

In the next step, the fibers and the thermoplastic polymer powder are laid down separately or as a fiber/powder mixture in an air stream in an amount of 10 to 300 g/m$^2$, preferably 10 to 100 g/m$^2$. In general, in the airlaid process, the fibers and the fiber-binding powder are mixed dry in a turbulent air stream, continuously or batchwise, and subsequently, the mixture is laid down in the air stream. This step may be repeated one or more times until the desired basic weight is achieved for the web. It is advantageous to effect a multiple application by means of a plurality of successive forming heads. The application rate is preferably 10 to 100 g/m$^2$ per process step. The weight fraction of fiber-binding powder is in each case 1 to 30% by weight, preferably 5 to 15% by weight, based on the total weight of fiber and polymer powder.

The fiber webs or fibers being laid should preferably have a residual moisture content of 5 to 15% by weight, since residual moisture causes the polymer powder to swell and provides for superior adhesion of the polymer powder to the fiber. In a further preferred embodiment, especially with regard to the use of water-activable polymer powders, the laid fiber webs or layers are moistened with water or steam, either before the next layer is laid on top or after all the layers have been laid down, in order that the polymer powder may be activated. To this end, the individual layers are moistened with 5 to 60% by weight, preferably 10 to 35% by weight, of water, based on the total weight of fiber and polymer powder. The moistening can be effected by means of water vapor or else by spraying with water; if appropriate, it is also possible to use combinations of the individual methods. When thick non-wovens are to be produced, steaming with hot water vapor is preferred.

The laid fiber material is generally dried and consolidated at temperatures of 80° C. to 260° C., preferably 120° C. to 200° C., if appropriate under a pressure of up to 100 bar, although the drying temperature and the pressure to be employed are primarily dependent on the nature of the fiber material. The process of the invention makes it possible to produce fibrous structures having a very high basis weight by airlaying. The basis weight of the fibrous structures is generally within the range from 30 g/m$^2$ to 1000 g/m$^2$, preferably within the range from 60 g/m$^2$ to 1000 g/m$^2$, especially within the range from 60 g/m$^2$ to 300 g/m$^2$.

In a preferred embodiment, pulverulent additives may be incorporated together with the fiber-binding powder, for example superabsorbents (SAPs), fillers such as silica gel, flame retardants, expandable microbeads or activated carbon. This may be used to condition the fibrous structures for certain applications without necessitating a further, complicated process step.

Fibrous structures having a very high basic weight, preferably 60 to 1000 g/m$^2$, can also be produced by using combinations of a polymer powder and an aqueous polymer dispersion. To this end, as described, a mixture of the fibers and the fiber-binding powder may be airlaid to form a textile sheet material which may be subsequently sprayed with an aqueous polymer dispersion instead of or in addition to being water-activated. Polymer powder and polymer dispersion may have the same polymer basis; however, it is also possible to use mutually different polymers from the group of the above-mentioned vinyl esters and methacrylic ester polymers, for example by laying down a water-activatable powder together with the fibers and spraying this fibrous structure with an aqueous dispersion of a non-water-activatable but sealable polymer.

It is also possible to spray the dispersion in the last step prior to the heat treatment. The spraying with a polymer dispersion may be effected from one side or from both sides. As well as producing better binding for thick fibrous structures, this leads to fibrous structures having better binding at the surfaces and to dustproof surfaces for the fibrous structure thus treated.

In these process variants, the polymer dispersion is used with a solids content of preferably 7 to 30%. The amount of polymer dispersion used is preferably 2 to 25% by weight of the fiber fraction. Drying and consolidation are effected similarly to the procedure described above. This process variant is preferred for the production of very thick fibrous structures or if the webs are to be laminated in a subsequent operation.

For lamination, the fibrous structures are treated in the above-indicated manner, with or without being sprayed with a polymer dispersion, and subsequently a further substrate is laid on top. The laminates are consolidated under the above-indicated temperature and pressure conditions. In lamination, two identical or different fibrous structures can be adhered to each other, or a fibrous structure can be adhered to a further substrate. Useful as substrates are polymeric films such as polyester films or polyolefin films, wovens and non-wovens such as cellulose webs, wood fiber boards such as chipboard and foamed sheetlike materials such as polyurethane foams.

In another embodiment, the last step prior to the heat treatment is carried out by laying down only one layer of fiber without addition of a polymer powder or a polymer dispersion. This provides fibrous structures particularly noticeable for reduced surface tackiness.

The products provided by the process of the invention are useful in automotive construction or in the building construction sector, for example as insulants, or for use in the hygiene sector, for example for manufacturing diapers or sanitary napkins.

The procedure of the invention also provides an economical way to produce bulky fiber webs which do not delaminate without further finishing. The fiber webs can be economically further processed in an integrated production process, for example, to form laminates with themselves or other webs to obtain multi-functional composites. The polymer powders also have a binding capacity for functional, pulverulent additives which are frequently present in fiber webs and are able to effectively bind these owing to the uniform distribution. Compared with conventional binding fibers, the use of binding powders provides better adhesion to natural fibers and improved dustproofing without the absorption capacity of the airlaid being restricted.

The examples hereinbelow illustrate the invention:

EXAMPLE 1 (COMPARATIVE)

An airlaid composed of cellulose fibers (fiber length 2 to 12 mm) and having a basic weight of 100 g/m$^2$ was sprayed with 10% by weight (s/s), based on the total weight of fiber and polymer, of an aqueous dispersion of a self-crosslinking vinyl acetate-ethylene-NMA interpolymer on both sides and then dried at 180° C. in a drying cabinet without pressure. The strength of the fiber web was tested using a peel seam test. To this end, 40 mm wide strips were prepared and then 5 individual strips were tested according to ISO 9073-3 and their results averaged. The peel seam strength of the airlaid was 0.15 N/cm.

EXAMPLE 2 (INVENTIVE)

Cellulose fibers 2 to 12 mm in length were laid to a basic weight of 50 g/m$^2$ and subsequently, in the form of a fiber/powder mixture, a layer of cellulose fiber was laid on top in a basic weight of 50 g/m$^2$ together with 20% by weight, based on the total weight of fiber and powder, of pulverulent vinyl acetate-diisopropyl fumarate copolymer containing 30% by weight of diisopropyl fumarate. The web was dried in the drying cabinet under the same conditions as in Comparative Example 1. The peel strength was 0.38 N/cm. Although a non-crosslinkable binder was used, the peel seam strength produced by powder binding was distinctly increased compared with Comparative Example 1.

EXAMPLE 3 (INVENTIVE)

Example 2 was repeated except that, after the web had been laid and before drying, 30% by weight of water, based on the total weight of fiber and powder, was sprayed on. The peel seam strength increased further to 0.41 N/cm.

EXAMPLE 4 (INVENTIVE)

Example 2 was repeated except that 10% by weight, based on the total weight of fiber and powder, of a 70:30 (w/w) mixture of the pulverulent binder of Example 2 and an SAP powder (Favor SX FAM) was used. Despite the high fraction of SAP powder, the peel seam strength at 0.30 N/cm was considerably higher than that from the use of a larger amount of crosslinkable binder dispersion (Comparative Example 1). No shedding of the superabsorbent powder was observable either.

EXAMPLE 5 (COMPARATIVE)

Example 2 was repeated except that 10% by weight, based on the total weight of fiber and polymer, of a pulverulent hydrophobic polyolefin copolymer (PE/PP) was used. The peel seam strength at 0.08 N/cm was considerably reduced compared with the vinyl ester or methacrylic ester polymers used according to the invention.

FIG. 1 illustrates a scanning electron micrograph of an airlaid (100 g/m$^2$) thermally consolidated with PE/PP bicomponent fibers. The poor wetting of the fluff pulp is readily apparent.

Figure 2:
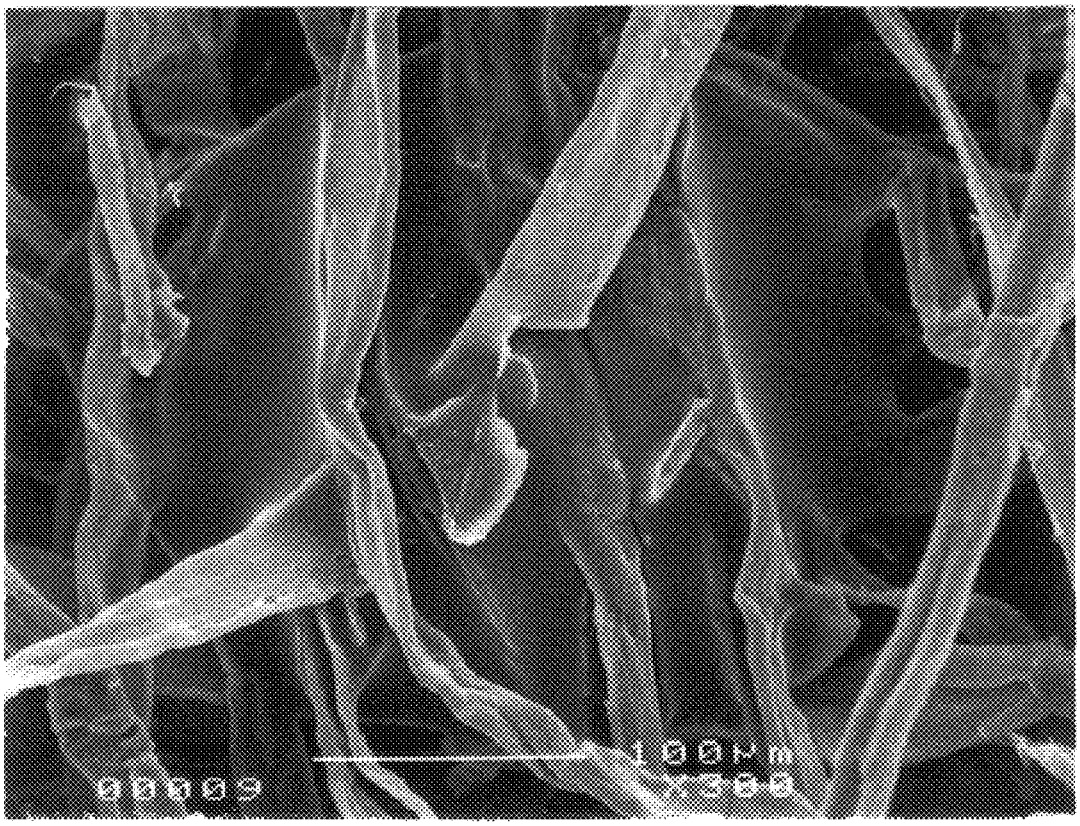

FIG. 2, in contrast, illustrates an airlaid (100 g/m$^2$) consolidated with a pulverulent binder (Inventive Example 3), which shows a very good wetting of the fibers.

What is claimed is:

1. A process for producing fiber webs by the airlaid process of laying down the fibers and the pulverulent binder in an air stream, which comprises a) a first step of laying a fiber web or fibers up to a basic weight of 10 to 50 g/m$^2$, b) a subsequent step of laying down fibers and a thermoplastic polymer powder based on polymers of one or more monomers selected from the group consisting of the vinyl esters and (meth)acrylic esters separately or as a mixture in the air stream in an amount of 10 to 300 g/m$^2$ and, if appropriate, repeating this step until the desired basic weight is obtained, and c) consolidating the fiber material at temperatures of 80° C. to 260° C. and, if appropriate, at a pressure of up to 100 bar.

2. A process as claimed in claim 1, wherein the polymer powder is based on short-chain vinyl esters having 1 to 4 carbon atoms in the carboxylic acid moiety and short-chain methacrylic or acrylic esters having 1 to 4 carbon atoms in the ester moiety.

3. A process as claimed in claim 1, wherein the polymer on which the powder is based is a copolymer which additionally contains units derived from 0.05 to 10.0% by weight, based on the total weight of the monomers, of polar comonomers selected from the group consisting of ethylenically unsaturated mono- and dicarboxylic acids and their amides, ethylenically unsaturated sulfonic acids and their salts, N-vinylpyrrolidone and/or crosslinkable comonomers.

4. A process as claimed in claim 1, wherein the polymer powder is based on hydrophilic polymers containing not less than 50% by weight of the above-mentioned short-chain vinyl esters or (meth)acrylic esters or at least 5% by weight of the polar comonomers mentioned, each percentage being based on the total weight of the monomers.

5. A process as claimed in claim 1, wherein the polymer powder is based on vinyl ester or a (meth)acrylate comonomer which contains at least 20% by weight of at least one hydrophobic comonomer selected from the group consisting of long-chain vinyl esters having 5 to 11 carbon atoms in the ester moiety, aromatic vinyls, vinyl halides, olefins, dienes and also a diester of a dicarboxylic acid.

6. A process as claimed in claim 1, wherein the polymers have a glass transition temperature Tg of −40° C. to +150° C.

7. A process as claimed in claim 1, wherein the laid fiber webs or layers are moistened with 5 to 60% by weight, based on the total weight of fiber and fiber-binding powder, of water or steam before the next layer is laid on top or after all the layers have been laid down.

8. A process as claimed in claim 1, wherein the polymer powder is added together with a pulverulent additive selected from the group consisting of a superabsorbent, a filler, flame retardant, expandable microbeads and activated carbon.

9. A process as claimed in claim 1, wherein combinations of polymer powder and aqueous polymer dispersion are used.

10. A process as claimed in claim 1, wherein the last step prior to the heat treatment is carried out by laying down only one layer of fiber without addition of polymer powder or polymer dispersion.

11. A fiber web having a basis weight of 30 $g/m^2$ to 500 $g/m^2$, obtainable by a process as claimed in claim 1.

12. The method of using the fiber web of claim 10 in automotive construction, the building construction sector and the hygiene sector.

* * * * *